United States Patent [19]

Neel et al.

[11] Patent Number: 4,710,738

[45] Date of Patent: Dec. 1, 1987

[54] MOULDED CASE CIRCUIT BREAKER

[75] Inventors: Jean-Philippe Neel, Meylan; Roger Case, Seyssins; Gilbert Garnier, Fontaine, all of France

[73] Assignee: Merlin Gerin, Grenoble, France

[21] Appl. No.: 870,412

[22] Filed: Jun. 4, 1986

[30] Foreign Application Priority Data

Jun. 12, 1985 [FR] France ..... 85 09003

[51] Int. Cl.[4] ..... H01H 9/00

[52] U.S. Cl. ..... 335/172; 335/170; 335/174

[58] Field of Search ..... 335/6, 10, 21, 35, 18, 335/16, 170, 172, 174

[56] References Cited

U.S. PATENT DOCUMENTS 2,759,063 8/1956 Rypinski .
3,016,435 1/1962 Schwartz .
3,171,921 3/1965 Woods .
3,774,129 11/1973 Sugiyama ..... 335/167

FOREIGN PATENT DOCUMENTS 2505452 8/1975 Fed. Rep. of Germany .

*Primary Examiner*—E. A. Goldberg
*Assistant Examiner*—Lincoln Donovan
*Attorney, Agent, or Firm*—Parkhurst & Oliff

[57] ABSTRACT

A moulded case circuit breaker has a toggle-joint mechanism, articulated on a hook and on a moving contact support. The toggle joint includes a swivel pin movably engaged in an aperture of the hook. When tripping takes place, the released hook pushes the toggle-joint, via the swivel pin and aperture, into a broken position to accelerate opening of the contacts. In the closed position, the toggle-joint is practically perpendicular to the hook.

7 Claims, 6 Drawing Figures

MOULDED CASE CIRCUIT BREAKER

BACKGROUND OF THE INVENTION

The invention relates to a moulded case low voltage electrical circuit breaker having three stable positions respectively open O, closed F and tripped DD.

The advantages of moulded case circuit breakers of the kind mentioned are well known and this technique is used for higher and higher ratings. Currents of high intensity require large cross-section conducting parts which are voluminous and heavy. It is also indispensable that the contact pressure and speed of separation of these contacts be increased in order to limit the duration of the breaking arc. All these modifications result in a particularly cumbersome and bulky operating mechanism, which limits the possibilities of using the moulded case technique.

The first object of the present invention is to enable an operating mechanism with increased contact separation speed to be produced without a notable increase in the volume occupied by this mechanism. Another object of the invention is to enable a circuit breaker mechanism to be produced providing strong acceleration of the moving contact as soon as the contacts separate.

A further object of the invention is to achieve a high current moulded case circuit breaker whose case has a relatively small height and whose contact pressure can withstand high currents.

SUMMARY OF THE INVENTION

The circuit breaker according to the invention is characterized by the fact that a hook bears a stop cooperating with an upper rod, in the course of pivoting of the released hook towards the tripped position DD of the circuit breaker, to move said upper rod by breaking the toggle-joint and to move the toggle-joint spindle into a position beyond the dead point of the pivoting handle, said dead point being defined by the alignment of the articulation spindle of the handle, the toggle-joint spindle and the anchoring point of the spring on the handle.

Pivoting of the hook subsequent to release of the latching device acts in two different ways on the toggle-joint, in this instance on the upper rod of the toggle-joint. On the one hand, pivoting of the hook moves the articulation spindle of the upper rod on the hook in an opening direction of the contacts and on the other hand pivoting of this upper rod, causes the toggle-joint to be broken to accelerate the opening movement of the moving contact. This dual action takes place as soon as the tripping movement begins, which favours fast contact separation and efficient limitation of the current broken. In the course of this tripping movement, the upper rod remains immobile in relation to the hook, thus limiting friction and slowing-down of the moving assembly movement. It will become apparent from the description that follows of an embodiment of the invention that the forced pivoting of the upper rod causes the toggle-joint spindle to move in a direction favouring passing beyond the dead point of the handle towards the tripped position. This particular feature allows a choice of the closed position of the handle in which the spring exerts an increased force on the toggle-joint maintaining a high contact pressure.

The link between the hook and the upper rod is advantageously performed by an aperture arranged in the hook and a swivel-pin borne by the upper rod and which engages in the aperture of the hook.

According to one embodiment of the invention, the upper rod extends in the closed position appreciably perpendicular to the hook, in such a way as to reduce the length of this upper rod and thereby the overall height of the mechanism while still keeping an amplified movement of the toggle-joint when tripping takes place. The large pivoting angle of the handle in the closed position enables a particularly simple handle locking device in the event of the contacts bonding to be achieved. The handle support is extended by a finger which can come in abutment against the articulation spindle of the moving contact in the event of the latter bonding before the handle has reached the opening dead point defined by the articulation point of the handle and the position of the toggle-joint spindle.

BRIEF DESCRIPTION OF THE DRAWINGS

Other advantages and characteristics will become more clearly apparent from the following description of different embodiments of the invention, given as examples only and represented by the accompanying drawings, in which.

DESCRIPTION OF THE PREFERRED EMBODIMENT

Figure 1:
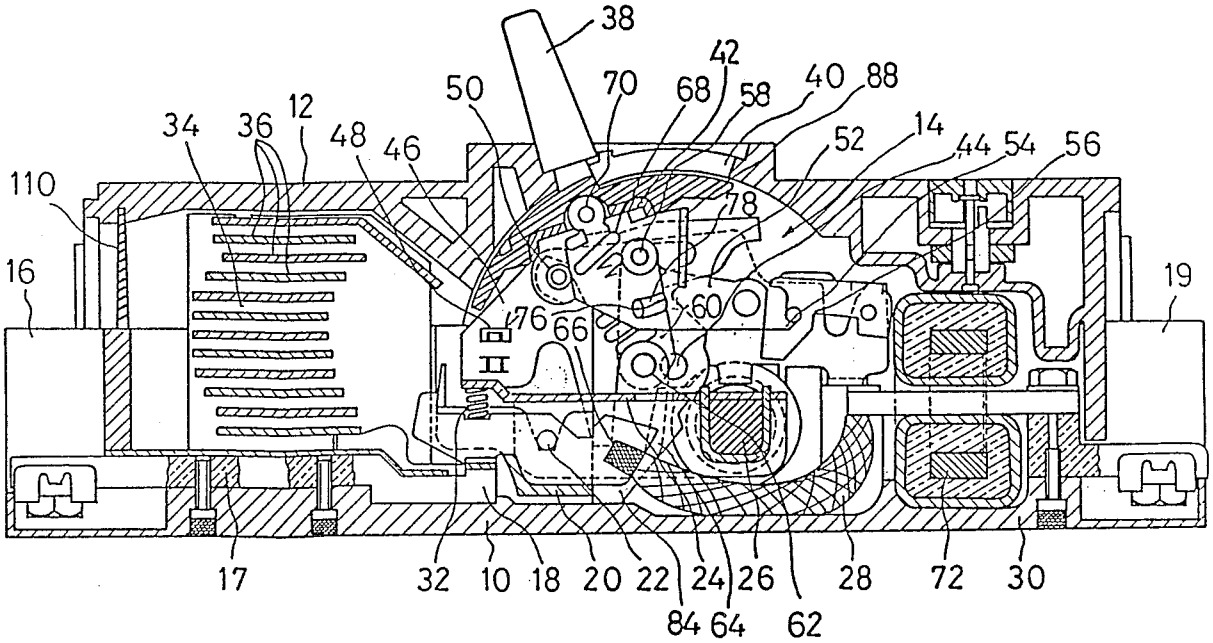
FIG. 1 is an elevation and axial section view of a circuit breaker according to the invention, represented in the closed position.
Figure 2:
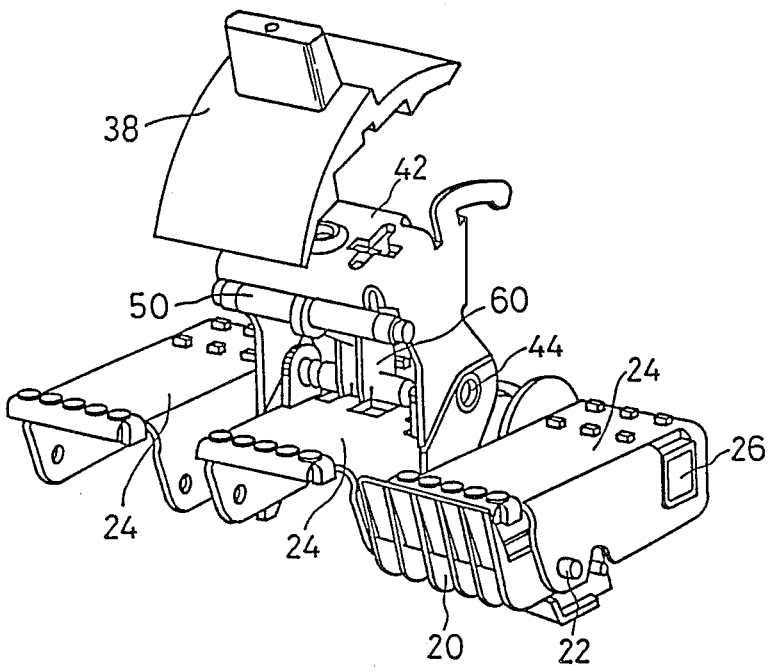
FIG. 2 is a schematic perspective view of the circuit breaker mechanism according to FIG. 1.

In the figures, a low voltage circuit breaker comprises a moulded case made from insulating material in two parts, namely a base 10 and a cover 12. The case of the circuit breaker, which is of the three-pole type, is subdivided by means of internal partitions into three compartments each accommodating the elements making up a pole. Only the central pole, which has associated with it an operating mechanism indicated by the general reference 14, is represented in FIG. 1, the other poles being identical. The base 10 has input 16 and output 19 terminals located on the two small opposite sides of the moulded case. The terminal 16 is connected by a conductor 17 running flat along the base 10 to a stationary contact 18, which cooperates in the circuit breaker closing position with moving contacts 20. These moving contacts 20 in the form of blades are mounted with limited pivoting on a spindle 22 securedly united to a contact support 24, the end of which is fastened to a rotating bar 26, connecting the supports 24 of the different poles. The moving contacts 20 are electrically connected by braids 28 and conductors 30 to the output terminal 19. Springs 32, fitted between the support 24 and the moving contacts 20 ensure contact pressure. It can easily be seen that a rotation of the bar 26 causes pivoting of the support 24 in the clockwise direction in FIG. 1, causing separation of the contacts 18, 20. The contacts 18, 20 have associated with them an arc chute 34 with deionization plates 36 extending parallel to the base 10 above the conductor 17. The operating mechanism 14 comprises a handle 38 which protrudes out through an opening 40, disposed in the cover 12. The handle 38 is rigidly fastened to a handle support 42, pivotally mounted on a fixed spindle 44 supported by a frame made up of two flange-plates 46, fixed to the case by means of screws 48. The flange-plates 46 frame the elements which make up the mechanism 14. A second fixed spindle 50 supported by the flange-plates 46 has articulated on it a hook 52, the opposite end 54 of which cooperates with a latching device 56. On a spindle 58 of the hook 52, a toggle-joint is articulated comprising an upper rod 60, a toggle-joint spindle 62 and a lower rod 64. The lower rod 64 is articulated by a spindle 66 on the moving contact support 24. A tension spring 68 is anchored between the toggle-joint spindle 62 and a point 70 of the handle support 42.

In the closed position of the contacts, represented in FIG. 1, the rods 60, 64 of the toggle-joint are appreciably aligned maintaining the support 24 in the closed position of the contacts 18, 20, due to the action of the spring 68. A circuit breaker of this kind is well-known in the art and it is sufficient to give a reminder that manual opening of the circuit breaker, controlled by pivoting of the handle 38 to the right in FIG. 1, causes the anchoring point 70 to be shifted to a position where the spring 68 exerts a breaking force on the toggle-joint 60, 64.

Closing of the contacts is controlled by pivoting the handle 38 in the opposite direction, bringing the toggle-joint into the extension position corresponding to closing of the contacts 18, 20. Tripping of the circuit breaker, i.e. automatic opening on a fault is brought about by unlocking of the latching device 56, which releases the end 54 of the hook 52. The latter pivots around its spindle 50 allowing the articulation point of the spindle 58 of the upper rod 60 to be shifted. The circuit breaker in FIG. 1 is equipped with an electronic trip release comprising a sensor in the form of a current transformer 72 which, in the event of an overcurrent or a short-circuit occurring, delivers a tripping signal to a relay 74 acting on the latching device 56. Electronic trip releases of this kind are well known and can moreover be replaced by standard thermal and/or magnetic trip releases.

Figure 3:
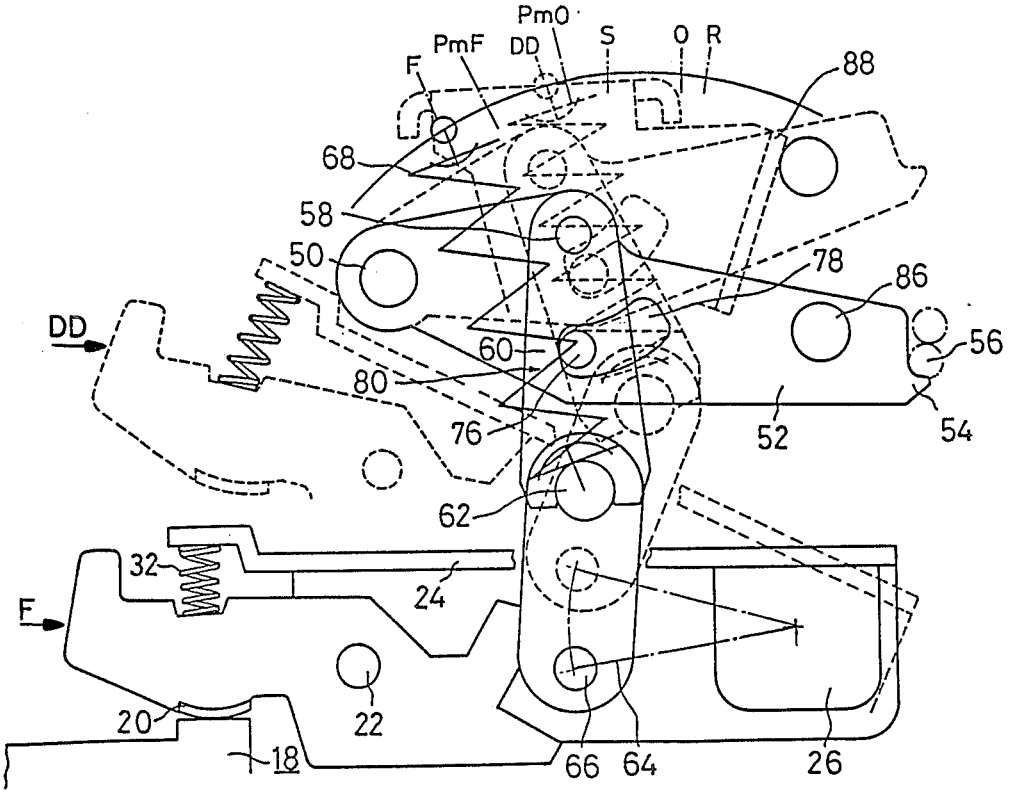
FIG. 3 is an enlarged scale view of the mechanism in figure 1, the closed position being represented by unbroken lines and the tripped position by broken lines.
Figure 5:
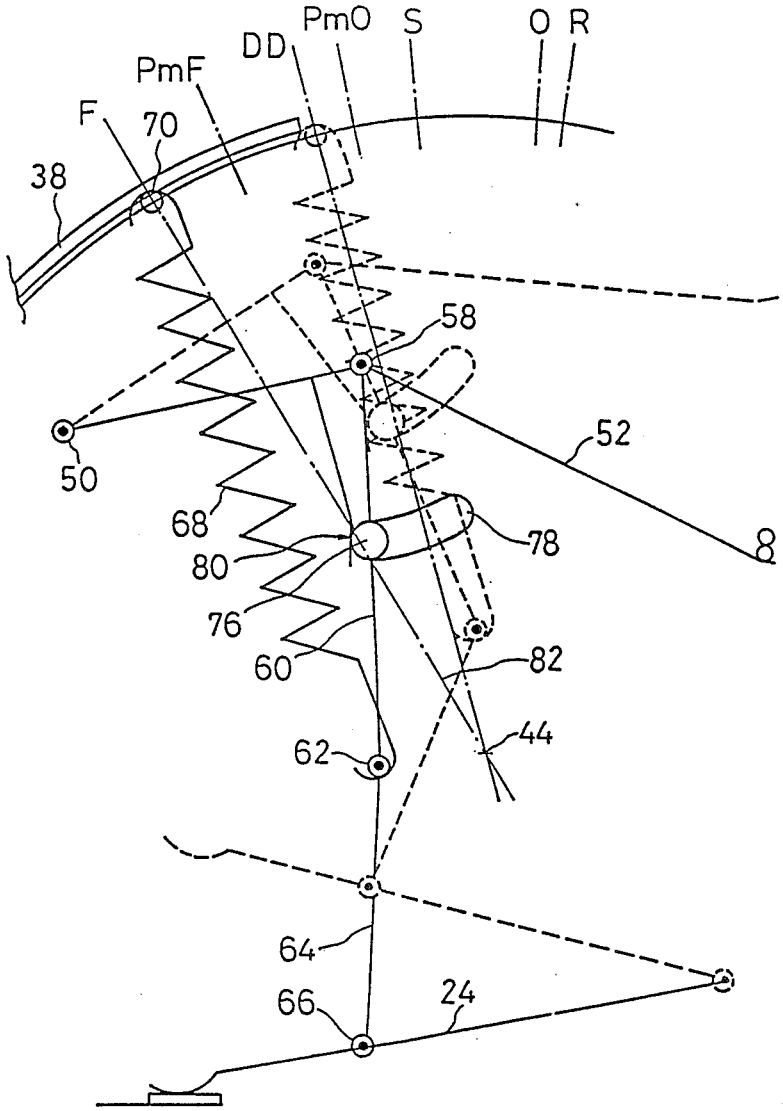
Figure 6:
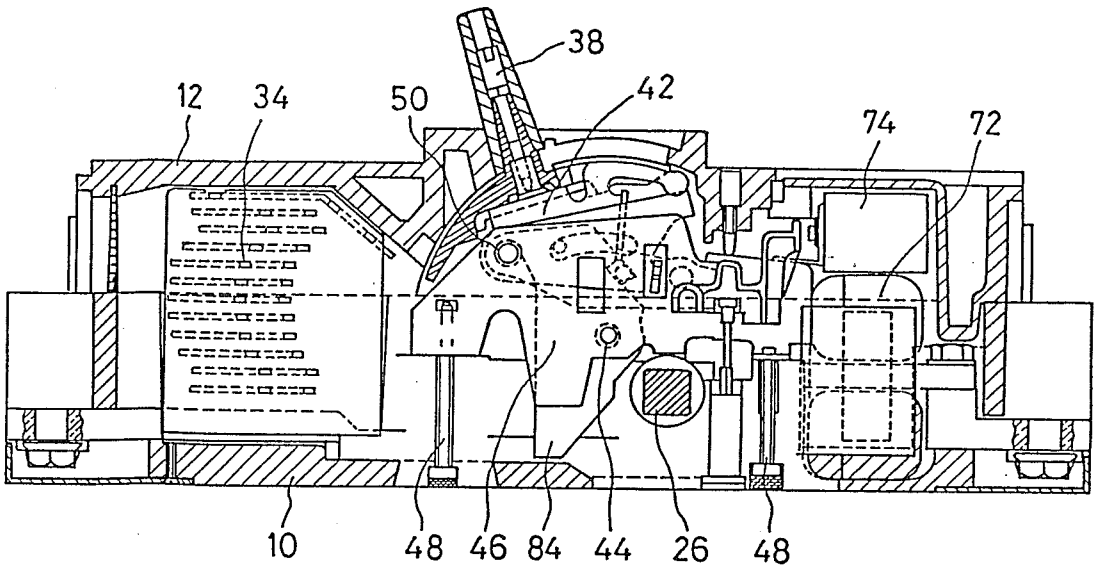
FIG. 6 is an elevation view of the circuit breaker, it being assumed that the side wall of the case has been removed.

According to the present invention, the upper rod 60 bears a swivel-pin or catch 76, engaged in a guide means or aperture 78, disposed in the hook 52. Referring more particularly to FIG. 3, it can be seen that in the closed position of the contacts 18, 20, the swivel-pin 76 bears on the bottom edge 80 of the aperture 78, facing in the direction of the pivoting spindle 50 of the hook 52. The upper rod 60 is appreciably perpendicular to the straight line joining the spindles 50, 58. When tripping takes place (illustrated by broken lines in FIG. 3), the released hook 52 pivots counter-clockwise around the spindle 50 shifting the spindle 58 fixing the upper rod 60 upwards and pushing the swivel-pin 76 on the bottom 80 of the aperture 78 in FIG. 3 to the right. This action of the hook 52 on the swivel-pin 76 forces the toggle-joint 60, 64 to bend, as soon as the hook 52 begins its movement accelerating the movement imposed on the support 24 of the moving contact 20. Referring more particularly to FIG. 5, which illustrates the kinematics of this tripping movement, it can be seen that the toggle-joint spindle 62 moves in the course of this movement beyond the closing dead point of the handle 38, represented by a broken line 82 joining the articulation spindle 44 of the handle 38 to the closing position point F of this handle. As soon as the spindle 62 crosses the straight line 82, the handle 38 is urged to the right to the position marked by the points DD in FIG. 5. The other positions of the handle 38 are also marked in FIG. 5, i.e. the closing dead point PMF, the opening dead point PMO, the disconnecting point S, the opening point O and the reloading point R. These points are well known to those skilled in the art and will become apparent from the description which follows. It should be noted that in the tripped position, the swivel-pin 76 is still bearing on the bottom 80 of the aperture 78, the upper rod 60 not having moved in relation to the hook 52, these two parts 60, 52, having moved as a single assembly. In the closed position, the straight line joining the spindles 50, 58 is appreciably parallel to the support 24 of the moving contact 20 and the articulation point 66 of the lower rod 64 on the support 24 is appreciably at the level of the moving contact 20. These arrangements enable the rods 60, 64 to be shortened, making it possible to reduce the overall height of the mechanism 14. The angle defined by the upper rod 60 and the spring 68 is large, for example close to 25 degrees, which provides a strong force maintaining the toggle-joint 60, 64, in the extension position and a high contact pressure. This large angle does not hinger movement of the handle 38 towards the tripping position DD, due to the pivoting imposed by the aperture 78 in the manner described above.

Figure 4:
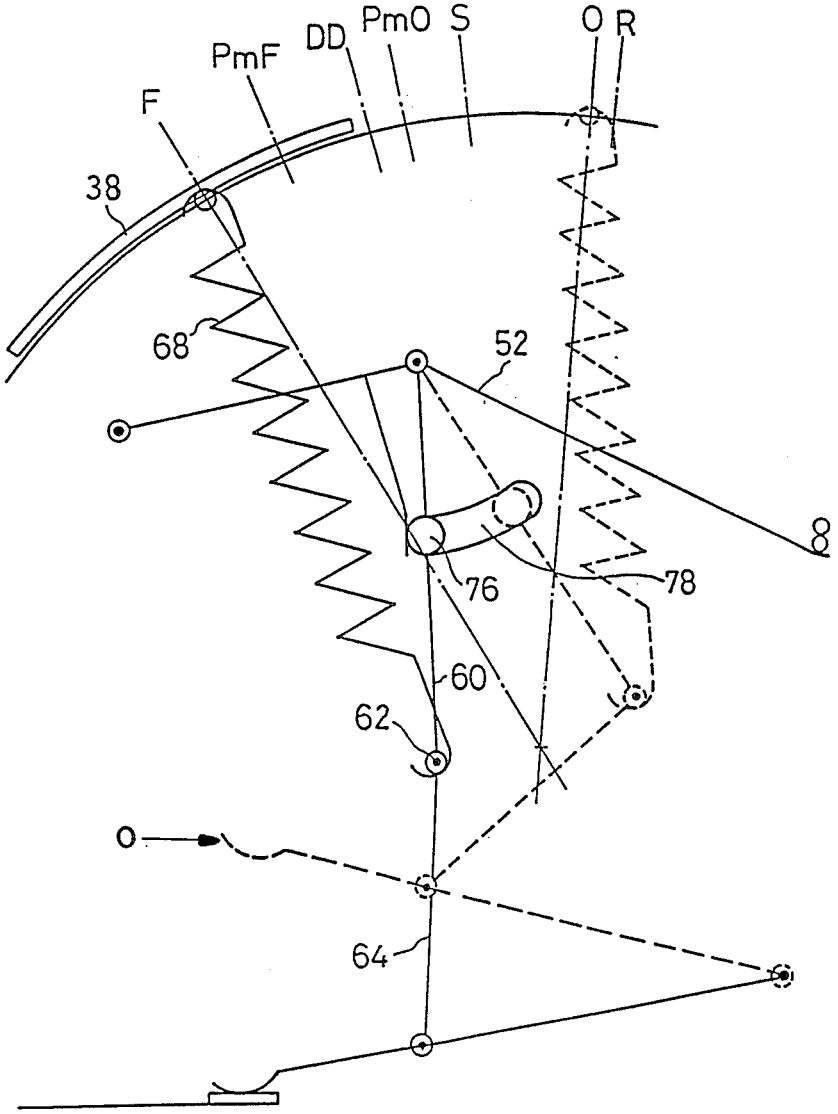
FIGS. 4 and 5 are diagrams illustrating the different positions of the mechanism.

FIG. 4 illustrates the manual circuit breaker opening operation by pivoting the handle 38 from the closed position F to the open position O. In the course of this pivoting, the action line of the spring 68 is shifted to the right in figure 4, in such a way as to exert a breaking force on the toggle-joint 60, 64. During this operation, the hook 52 remains immobile, the swivel-pin 76 sliding in the aperture 78. Such an operation is classical, reclosing of the circuit breaker being performed by pivoting of the handle 38 in the opposite direction.

The handle support 42 presents an extension 84 beyond its pivoting spindle 44 which comes into abutment against the articulation spindle 22 of the moving contact 20 in the event of the contacts 18, 20 becoming bonded together. This abutment action prevents the handle 38 pivoting beyond the position S, representative of bonding of the contacts 18, 20. When the handle 38 is released, it returns to the closed position F indicating the closed position of the circuit breaker. It is clear that in normal operation, the spindle 22 accompanies the support 24 in its opening movement avoiding the extension 84 acting as a stop and prevention of the handle 38 moving to the opening position. Contact bonding indication devices of this kind are well known in the art, the kinematics of the mechanism according to the invention enabling this to be achieved using extremely simple and reliable means.

The hook 52 bears in the vicinity of its end 54 a transverse reloading spindle 86. To this end, the handle support 42 presents stop surfaces 88, to push the transverse spindle 86 towards the latching position in the course of pivoting of the handle 38 towards the opening O and reloading R positions on the right in FIG. 3. The transverse spindle 86 constitutes at the same time a stop defining the tripping position DD of the handle 38.

It is necessary to give a more detailed description of the operation of the mechanism which is made clear by the aforegoing explanation and it is sufficient to give a reminder that this mechanism is particularly simple and rugged allowing high contact pressures to be applied and fast movement of the contacts right from the beginning of opening of the circuit breaker. The tripping movement is performed by simple rotations involving extremely low friction forces, which contributes to the speed of opening.

What we claim is :

1. A moulded case low voltage electrical circuit breaker having stationary and moving contacts assuming three stable positions respectively an open position, a closed position; and a tripped position, said circuit breaker comprising:

at least one stationary contact and one moving contact fitted in said case, a moving contact support pivotally mounted in said case to bring said contacts respectively into the closed position and the open position, an operating mechanism, housed in said case, to actuate said support between the open and closed positions of said contacts, said mechanism having a pivoting handle controlling manual opening and closing of the circuit breaker and a frame fixed to said case having a fixed spindle and a latching device, a hook pivotally mounted on the fixed spindle of said frame and cooperating with the latching device, release of said latching device causing tripping of the circuit breaker, a toggle-joint comprising an upper rod and a lower rod and a toggle-joint spindle connecting said rods, a free end of the upper rod being articulated by a spindle on the hook and an end of the lower rod being articulated on said support, a tension spring anchored on the toggle-joint spindle and on the handle to urge the toggle-joint respectively to an extension position, when the handle is in the circuit breaker closed position, and to a broken position when the handle is in the open position, the hook being released by unlocking of the latching device thereby causing the hook and toggle-joint assembly to move to the tripped position of the circuit breaker, and an aperture functioning as a guide means in said hook for cooperating with a catch on the upper rod during tripping operation of the circuit breaker, said tripping operation pivoting said hook to move both said articulated spindle of the upper rod and said catch of the upper rod thereby breaking the toggle-joint and bringing the toggle-joint spindle to a position beyond the dead point of said pivoting handle, said dead point being defined by the alignment of the articulation spindle of the handle, the toggle-joint spindle and the anchoring point of the spring on the handle.

2. The circuit breaker according to claim 1, wherein said catch is a swivel pin on said upper rod, and said guide means is constituted by the bottom edge of an aperture disposed in the hook, said bottom edge abutting said swivel-pin securedly united with the upper rod and engaged in said aperture in the course of a tripping operation.

3. The circuit breaker according to claim 2, wherein said guide means creates a rigid connection between the hook and the upper rod to move them as a single assembly in the course of a tripping operation.

4. The circuit breaker according to claim 3, wherein said guide means is disposed in such a way as not to hinder the free pivoting of the upper rod in the course of manual opening and closing operations.

5. The current breaker according to claim 1, wherein in the closed position, the angle having as its apex the articulation spindle of the upper rod on the hook and defined by the pivoting spindle of the hook and the toggle-joint spindle is close to a right-angle.

6. The circuit breaker according to claim 1, wherein in the closed position, the straight line passing through the articulation spindle of the upper rod and the pivoting spindle of the hook is appreciably parallel to said moving contact support.

7. The circuit breaker according to claim 1, wherein said hook bears at its end near the latching device a transverse spindle and the handle bears stops cooperating with said transverse spindle to move the hook to the latching position in the course of a reloading movement of the handle.

* * * * *